US007479737B2

(12) United States Patent
Kwon

(10) Patent No.: US 7,479,737 B2
(45) Date of Patent: Jan. 20, 2009

(54) PLASMA DISPLAY PANEL INCORPORATING NON-DISCHARGE AREAS BETWEEN DISCHARGE CELLS

(75) Inventor: Jae-Ik Kwon, Suwon-si (KR)

(73) Assignee: cSamsung SDI Co., Ltd., Suwon-si, Gyeonggi-do (KR)

( * ) Notice: Subject to any disclaimer, the term of this patent is extended or adjusted under 35 U.S.C. 154(b) by 426 days.

(21) Appl. No.: 11/302,442

(22) Filed: Dec. 14, 2005

(65) Prior Publication Data

US 2006/0145612 A1 Jul. 6, 2006

(30) Foreign Application Priority Data

Jan. 5, 2005 (KR) ..... 10-2005-0000798

(51) Int. Cl.
*H01J 17/49* (2006.01)

(52) U.S. Cl. ..... 313/584; 313/582; 313/586; 313/583

(58) Field of Classification Search ..... 313/582–587
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Shinoda et al. | |
| 5,724,054 | A | 3/1998 | Shinoda | |
| 5,786,794 | A | 7/1998 | Kishi et al. | |
| 5,952,782 | A | 9/1999 | Nanto | |
| 5,967,872 | A * | 10/1999 | Betsui et al. | 445/24 |
| 6,008,582 | A * | 12/1999 | Asano et al. | 313/582 |
| RE37,444 | E | 11/2001 | Kanazawa | |
| 6,630,916 | B1 | 10/2003 | Shinoda | |
| 6,661,170 | B2 * | 12/2003 | Amemiya | 313/582 |
| 6,707,436 | B2 | 3/2004 | Setoguchi et al. | |
| 6,784,617 | B2 * | 8/2004 | Jeong et al. | 313/586 |
| 2002/0003405 | A1 * | 1/2002 | Kang | 313/586 |
| 2006/0226778 | A1 * | 10/2006 | Choo | 313/582 |

FOREIGN PATENT DOCUMENTS

JP 2845183 10/1998

(Continued)

OTHER PUBLICATIONS

*Office action* from the Korean Intellectual Property Office issued in Applicant's corresponding Korean Patent Application No. 10-2005-0000798 dated Jun. 29, 2006.

(Continued)

*Primary Examiner*—Mariceli Santiago
(74) *Attorney, Agent, or Firm*—Robert E. Bushnell, Esq.

(57) ABSTRACT

A Plasma Display Panel (PDP) displays images of high image quality by sufficiently exhausting an impurity gas and charging a discharge gas and by preventing cross talk from occurring between discharge cells. The PDP includes a transparent front substrate and a rear substrate facing the front substrate; a plurality of barrier ribs, arranged between the front and rear substrates, and oriented in a direction to define a plurality of discharge cells in which a discharge occurs; a plurality of electrodes adapted to receive electrical potentials to generate electric fields in the discharge cells; a phosphor layer arranged in the discharge cells; and a discharge gas contained within the discharge cells.

14 Claims, 4 Drawing Sheets

FOREIGN PATENT DOCUMENTS

| | | |
|---|---|---|
| JP | 2917279 | 4/1999 |
| JP | 2000-311613 | 11/2000 |
| JP | 2001-043804 | 2/2001 |
| JP | 2001-325887 | 11/2001 |
| JP | 2001-325888 | 11/2001 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Office Action* from the Japanese Patent Office issued in Applicant's corresponding Japanese Patent Application No. 2006-000145 dated Jul. 22, 2008.

* cited by examiner

PLASMA DISPLAY PANEL INCORPORATING NON-DISCHARGE AREAS BETWEEN DISCHARGE CELLS

CLAIM OF PRIORITY

This application makes reference to, incorporates the same herein, and claims all benefits accruing under 35 U.S.C. §119 from an application entitled PLASMA DISPLAY PANEL, earlier filed in the Korean Intellectual Property Office on Jan. 5, 2005 and there duly assigned Serial No. 10-2005-0000798.

BACKGROUND OF THE INVENTION

1. Field of the Invention

The present invention relates to a Plasma Display Panel (PDP), and more particularly, to a PDP displaying high quality images, in which exhaustion of an impurity gas and filling of a discharge gas are adequately performed while preventing cross talk from being generated between discharge cells.

2. Description of the Related Art

Plasma Display Panels (PDPS) display images via phosphor materials excited by ultraviolet rays generated by a gas discharge. PDPs are considered to be the next generation of display panels since they provide high resolution images on large screens.

The PDPs can be classified into Alternating Current (AC) PDPs, Direct Current (DC) PDPs, and hybrid PDPs according to the structure and operational principles thereof. Moreover, the AC and DC PDPs are divided into surface discharge PDPs and face discharge PDPs according to the discharge structures. However, AC surface discharge PDPs are mainly used nowadays.

Since the PDP displays images by light emission through a gas discharge, the discharge gas contained within the PDP, and the mixing ratio and the purity of the discharge gas seriously affect the properties of the displayed images. Therefore, a high purity discharge gas with a predetermined mixing ratio should be used.

However, when the PDP is fabricated, an impurity gas can remain in the PDP and be mixed with the discharge gas when the discharge gas is filled in the PDP. Thus, the characteristics of the discharge gas are changed, and the displayed image can be of low quality.

In addition, if a path for exhausting the impurity gas is formed in the PDP, charged particles move fast through the exhaustion path and cross talk can be generated between adjacent pixels, thereby degrading the image quality. Therefore, exhaustion of the impurity gas and charging of the discharge gas must be performed while preventing crosstalk from being generated between discharge cells.

SUMMARY OF THE INVENTION

The present invention provides a Plasma Display Panel (PDP) in which exhaustion of an impurity gas remaining in the panel and filling of a discharge gas in the panel are efficiently performed.

The present invention also provides a PDP that displays high quality images, in which exhausting of an impurity gas and filling of a discharge gas are adequately performed while preventing crosstalk from being generated between neighboring discharge cells.

The present invention also provides a PDP having increased lifespan by efficiently exhausting an impurity gas.

According to one aspect of the present invention, a Plasma Display Panel (PDP) is provided including: a transparent front substrate and a rear substrate facing the front substrate; a plurality of barrier ribs, arranged between the front and rear substrates, and oriented in a direction to define a plurality of discharge cells in which a discharge occurs; a plurality of electrodes adapted to receive electrical potentials to generate electric fields in the discharge cells; a phosphor layer arranged in the discharge cells; and a discharge gas contained within the discharge cells.

The discharge cells are preferably staggered with respect to each other in the direction in which the barrier ribs are oriented.

Each of the barrier ribs is preferably oriented alternately in left and right directions with respect to a direction in which the barrier rib extends. Each barrier rib preferably further includes a protrusion protruding in a direction crossing the barrier rib.

The PDP preferably further includes a non-discharge area where the gas discharge does not occur, the non-discharge area being arranged between the discharge cells in a direction in which the barrier ribs extend. The PDP preferably further includes a recess portion arranged on a portion of the barrier rib defining the non-discharge area.

The electrodes preferably include sustain electrodes extending in a direction crossing a direction in which the barrier ribs extend, and address electrodes extending to cross the sustain electrodes at the discharge cells.

According to another aspect of the present invention, a Plasma Display Panel (PDP) is provided including: a transparent front substrate and a rear substrate facing the front substrate; a plurality of barrier ribs, arranged between the front and rear substrates, and oriented in a zigzag direction to define a plurality of discharge cells in which a discharge occurs; a plurality of electrodes adapted to receive electrical potentials to generate electric fields in the discharge cells; a phosphor layer disposed in the discharge cells; and a discharge gas contained within the discharge cells; the discharge cells adjacent to each other in a direction in which the barrier ribs extend are eccentric with respect to each other.

Each of the barrier ribs is preferably oriented alternately in left and right directions with respect to a direction in which the barrier rib extends. Each barrier rib further includes a protrusion protruding in a direction crossing the barrier rib. The protrusion preferably extends in both directions toward insides of the discharge cells defined by the barrier ribs.

The PDP preferably further includes a non-discharge area where the gas discharge does not occur, the non-discharge area being arranged between the discharge cells in a direction in which the barrier ribs extend. The PDP preferably further includes a recess portion arranged on a portion of the barrier rib defining the non-discharge area.

The electrodes preferably include sustain electrodes extending in a direction crossing a direction in which the barrier ribs extend, and address electrodes extending to cross the sustain electrodes at the discharge cells.

The PDP preferably further includes a front dielectric layer covering the sustain electrodes arranged on the front substrate, the sustain electrodes being supported and arranged on the front substrate.

The address electrodes are preferably supported and arranged on the rear substrate.

The PDP preferably further includes a rear dielectric layer covering the address electrodes arranged on the rear substrate.

The address electrodes are preferably staggered with respect to each other along a direction in which the barrier ribs extend.

BRIEF DESCRIPTION OF THE DRAWINGS

A more complete appreciation of the present invention, and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
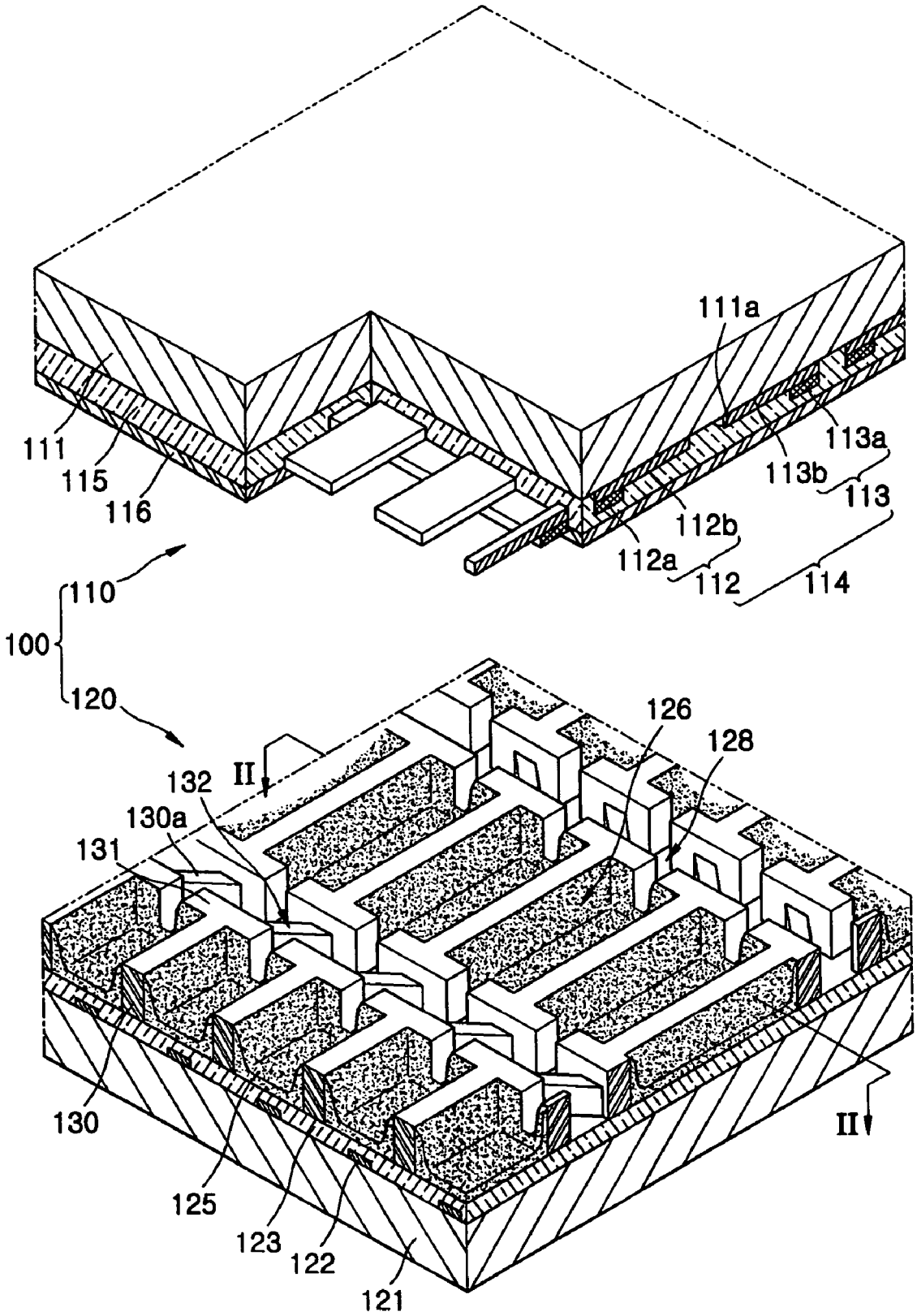
FIG. 1 is an exploded perspective view of a Plasma Display Panel (PDP) according to an embodiment of the present invention.
Figure 2:
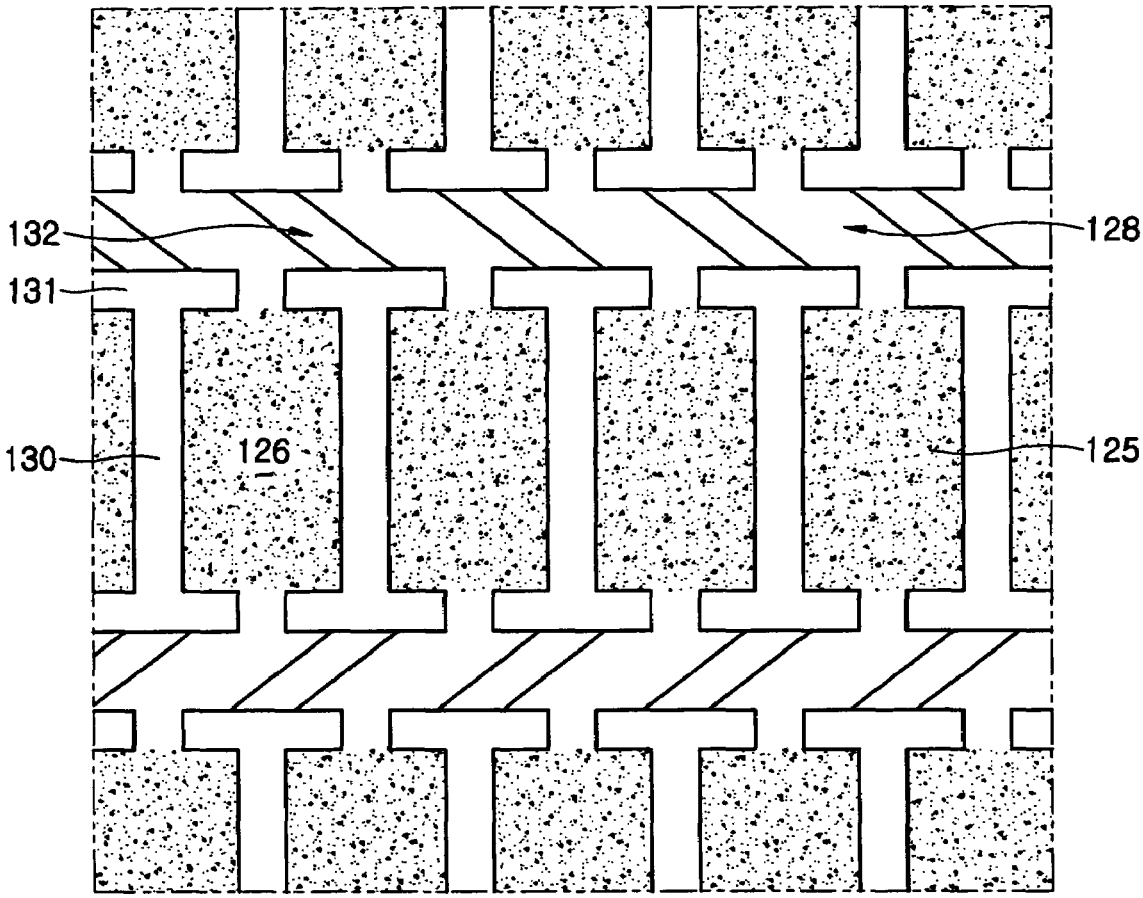
FIG. 2 is a cross-sectional view of the PDP taken along line II-II of FIG. 1.
Figure 3:
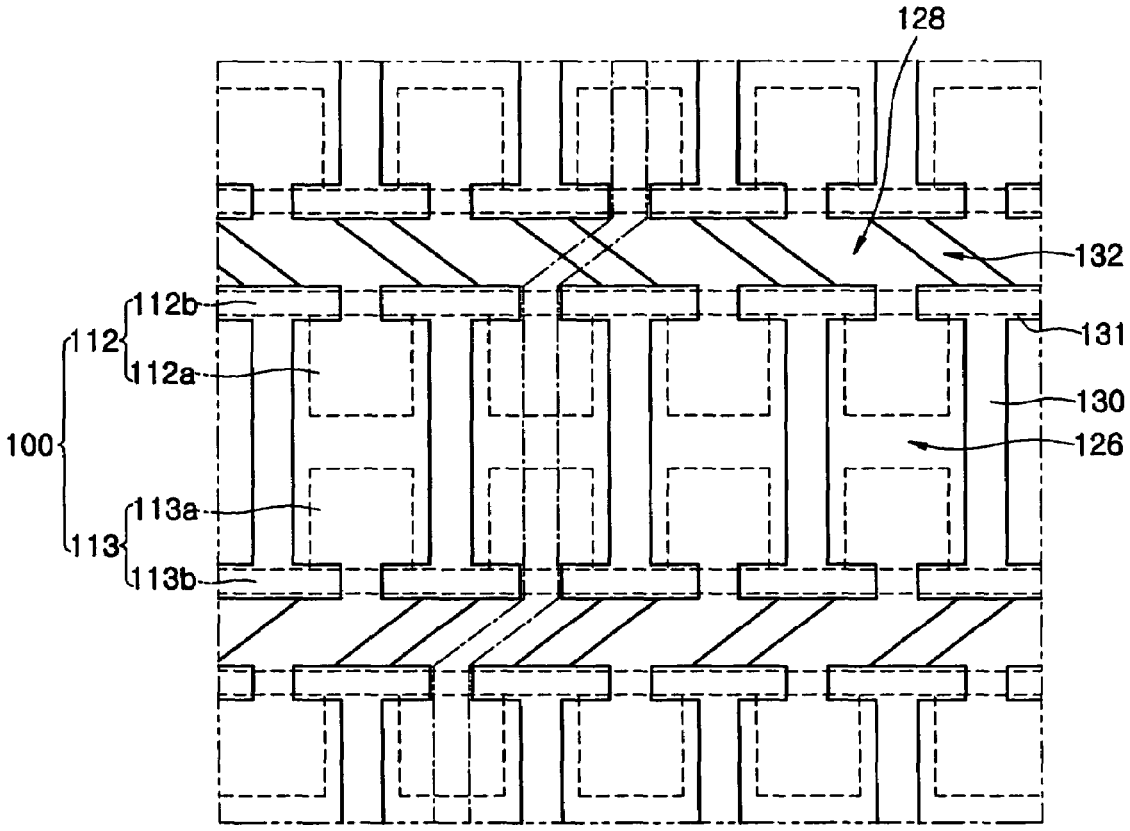
FIG. 3 is a cross-sectional view of electrode arrangements in the PDP of FIG. 1.

Referring to FIGS. 1 through 3, a Plasma Display Panel (PDP) 100 includes a front panel 110 and a rear panel 120. The front panel 110 includes a transparent front substrate 111, sustain electrodes 114 including X electrodes 113 and Y electrodes 112 disposed on the front substrate 111 and forming electric fields in discharge cells 126 by receiving an electrical potential, a front dielectric layer 115 formed on the front substrate 111 to cover the sustain electrodes 114, and a protective layer 116 covering the front dielectric layer 115.

The rear panel 120 includes a rear substrate 121 facing the front substrate 111, address electrodes 122 formed on the rear substrate 121 and crossing the sustain electrodes 114 at the discharge cell 126, and a rear dielectric layer 123 formed on the rear substrate 121 to cover the address electrodes. The address electrodes 122 are preferably disposed in a direction in which a plurality of barrier ribs 130 are formed.

The barrier ribs 130 are disposed between the front substrate 111 and the rear substrate 121 in a succession of parallel rows. Each of the barrier ribs 130 is arranged in a predetermined direction to define a plurality of discharge cells 126 in which a discharge occurs. In addition, the discharge cells 126 adjacent to each other in a direction in which the barrier ribs 130 extend can be staggered as shown in FIG. 1.

In addition, referring to FIG. 1, each of the barrier ribs 130 is wound alternately arranged to the left and right sides based on the direction in which the barrier ribs 130 extend. Through the above arrangement of the barrier ribs 130, an impurity gas can be exhausted sufficiently and a discharge gas can be filled sufficiently, and thus, the purity of the discharge gas in the discharge cells 126 can be improved. The arrangement of the barrier ribs 130 is described in more detail later.

In addition, each barrier rib 130 includes a protrusion 131 that protrudes in a direction crossing the direction where the barrier rib 130 extends, and the protrusion 131 of the barrier rib 130 protrudes in both directions toward the inside of the discharge cell 125 defined by the barrier ribs 130. According to this structure, cross talk between neighboring discharge cells 126 during the gas discharge can be prevented from occurring, and the image quality is not degraded. The structure is described in more detail later.

The PDP 100 can include a non-discharge area 128, where the gas discharge does not occur, between neighboring discharge cells 126 with respect to the direction where the barrier ribs 130 extend. The non-discharge area 128 provides a space where bus electrodes 113*a* and 112*a* can be disposed as shown in FIG. 3.

In addition, a recess portion 132 can be formed on a portion 130*a* of each barrier rib 130 defining the non-discharge area 128. The recess portion 132 can perform as a path for additionally exhausting the impurity gas and filling the discharge gas.

The rear panel 120 includes a phosphor layer 125 that is applied in the discharge cells 126, at least on a part of the space defined by the barrier ribs 130 and the rear dielectric layer 123, and the discharge gas is filled in the discharge cells 126.

Structures of the PDP 100 are described in more detail as follows.

When the Y and X electrodes 112 and 113 included in the sustain electrode 114 are supported by the front substrate 111 as described above, the X and Y electrodes 113 and 112 are disposed on a light path of the light generated by the phosphor layer 125 and blocks the visible light. Therefore, the X and Y electrodes 113 and 112 can include transparent electrodes 113*b* and 112*b* formed of Indium Tin Oxide (ITO).

The transparent electrodes 112*b* and 113*b* are not used independently because of their high resistance. Therefore, it is desirable that the transparent electrodes 112*b* and 113*b* be connected to bus electrodes 112*a* and 113*a* that are formed of an inexpensive metal having a high electrical conductivity, for example, aluminum, copper, or chromium.

In addition, the sustain electrodes 114 can include only the X and Y electrodes 113 and 112 as shown in FIG. 1, or can further include an intermediate electrode (not shown) to which an electrical potential is applied, between the X and Y electrodes 113 and 112 in order to increase the distance between the X and Y electrodes 113 and 112 and to generate a sustain discharge at a low electrical potential. Therefore, the sustain electrodes 114 of the present invention are not limited to the example of FIG. 1, that is, the sustain electrode including the X and Y electrodes 113 and 112.

In addition, the sustain electrodes 114 can be formed by applying an electrode paste including the electrode material on the front surface of the front substrate 111 in a screen printing method, and drying and baking the paste, or can be formed by a photolithography method by etching the electrode paste including a photo-sensitive photoresist using a photosensitive apparatus.

The front dielectric layer 115 induces charged particles by the electrical potential applied to the sustain electrodes 114 to induce wall charges in the discharge cells 126, and to protect the sustain electrodes 114.

The front dielectric layer 11 can be formed by applying a dielectric paste formed of PbO or $SiO_2$ on the front substrate 111 in the screen printing method, and baking the paste.

The protective layer 116 is formed of MgO to increase the emission of secondary electrons during the discharge, and protects the front dielectric layer 115 and the sustain electrodes 114 from colliding with the charged particles. Thus, the lifespan of the PDP can be increased. The protective layer 116 can be disposed easily in a deposition method.

The address electrodes 122 can be formed on the front surface of the rear substrate 121 by a screen printing method or a photolithography method. The address electrodes 112 are not necessarily formed on the front surface of the rear substrate 121, but can be formed on an ultraviolet ray reflection layer (not shown) or a visible light reflection layer (not shown) that is formed on the front surface of the rear substrate 121.

Since the address electrodes 122 are not located on the light path, they can be formed of silver, copper, or chromium, which are inexpensive and have a high electrical conductivity.

The rear dielectric layer 123 can be formed in the same way as the front dielectric layer 115. If the address electrodes 122 are covered by the phosphor layer 125, the phosphor layer 125 can substitute for the rear dielectric layer 123, and thus, the rear dielectric layer 123 is not an essential element. However, if the barrier ribs 130 are formed by a sand blasting method, it is desirable that the rear dielectric layer 123 be formed since the address electrodes 122 can be etched and damaged.

The phosphor layer 125 can include red, green, and blue phosphor layers for displaying a full-color image on the PDP 100, and the red, green, and blue phosphor layers are disposed in the discharge cells 125 to form unit pixels.

When the rear dielectric layer 123 is formed, a phosphor paste including one of the red, green, and blue phosphor materials, a solvent, and a binder are applied to the front surface of the rear dielectric layer in the discharge cell and some portions of the barrier rib surfaces, and dried and baked to complete the phosphor layer 125.

The red phosphor material can be $(Y,Gd)BO_3:Eu^{3+}$, the green phosphor material can be $Zn_2SiO_4:Mn^{2+}$, and the blue phosphor material can be $BaMgAl_{10}O_{17}:Eu^{2+}$.

When the rear dielectric layer 123 is formed, a barrier rib paste including a glass component having Pb, B, Si, or Al, a filler such as $ZrO_2$, $TiO_2$, or $Al_2O_3$, and a pigment such as Cr, Cu, Co, Fe, or $TiO_2$ are applied to the rear dielectric layer 123, and a mask pattern inducing a predetermined shape is laid on the paste, and after that, the barrier rib paste is etched by accelerated ceramic particles (sand blasting method). Otherwise, the barrier ribs 130 can be formed by the photolithography method using exposing and developing processes.

A discharge gas having a lower pressure than the atmospheric pressure (about 0.5 atm or less) is filled in the discharge cells 126. The discharge gas is one of Ne having Xe in a concentration of about 10%, He, Ar, an a mixture gas including two or more of the previous gases.

Figure 4:
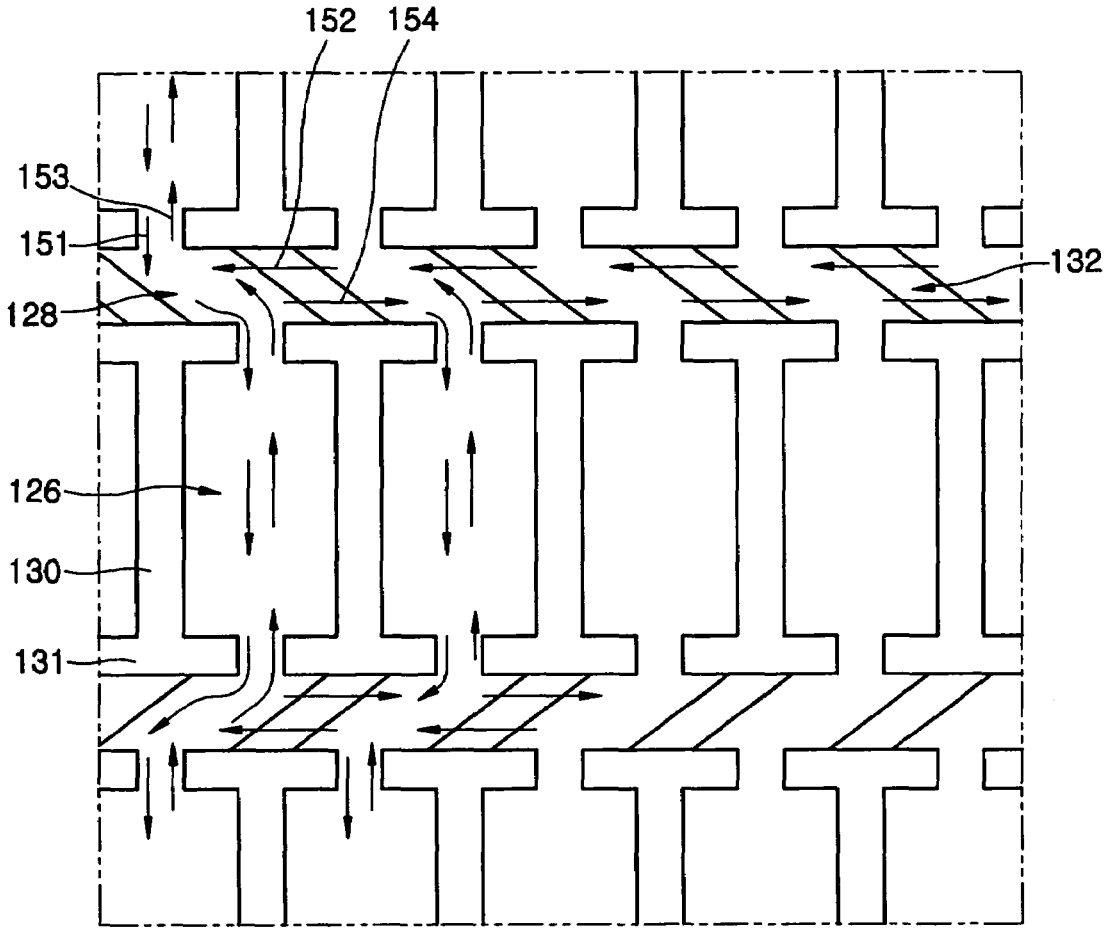
FIG. 4 is a view of the exhausting of an impurity gas and the filling of a discharge gas in the PDP of FIG. 1.

Hereinafter, functions of the barrier ribs 130 are described in more detail by referring to FIG. 4.

The emission of visible light in the discharge cells 126 is generated by ultraviolet rays of 147 nm and 174 nm that are generated when an energy level of the Xe gas decreases to a low energy level. That is, the ultraviolet rays having the above wavelengths excite the phosphor material in the phosphor layer 125 and make the phosphor layer emit visible light. The Ne, He, or Ar mixed with the Xe gas helps the Xe gas generate the discharge by a panning effect, that is, a gas in a metastable state is generated to accelerate ionization of other kinds of gases.

Since the plasma discharge occurs due to the interaction between the discharge gases and an image is displayed, the kinds of the discharge gases, the mixture rate of the discharge gases, and the existence of an impurity gas in the discharge gas largely affect the display properties of the PDP.

The phosphor layer 125 disposed in the discharge cells 126 is formed through the drying and baking processes, and the barrier ribs 130 also undergo the drying and baking processes. During the baking process, volatile materials included in the materials forming the barrier ribs 130 and the phosphor layer 125 can be volatilized in the impurity gas, and some of the impurity gas is discharged out of the discharge cells 126 and some remains in the discharge cells 126.

If the etching or photolithography process is used to form the layers, the impurity gas is generated due to the volatilization of the volatile materials, and some of the impurity gas remains in the discharge cells 126. When the impurity gas remains in the discharge cells 126, the impurity gas is mixed with the discharge gas that will be charged in the next process, the properties of the discharge gas are changed, and thus, the display properties of the PDP are degraded. Moreover, the impurity and discharge gases can cause a chemical reaction when the plasma discharge is generated, and thus, the display properties can be further degraded.

In addition, the protective layer 116 formed of MgO can be contaminated by the chemical reaction with the impurity gas, and the performance of the protective layer 116, that is, the protection and emission of secondary electrons, can be largely degraded. Therefore, the lifespan of the PDP is greatly reduced.

In consideration of the characteristics of the impurity gas described above, it is important to exhaust the impurity gas and fill the discharge gas sufficiently during the fabrication of the PDP.

If the barrier ribs define the discharge cells of closed type in a matrix form, the paths for exhausting the impurity gas and filling the discharge gas cannot be ensured sufficiently due to the barrier ribs blocked on the space between the barrier ribs, through which the impurity gas can be exhausted and the discharge gas can be filled. Therefore, the above problems can occur.

The discharge cells can be defined by the barrier ribs having a stripe shape and extending in a predetermined direction. In this case, the above paths can be sufficiently formed between the barrier ribs, and thus, the impurity gas can be exhausted and the discharge gas can be filled sufficiently through the paths. However, since the discharge cells cannot be defined exactly, it is difficult to define exactly the base unit for displaying images. In addition, cross talk is generated between the neighboring discharge cells, and thus the image quality is degraded.

However, according to the PDP 100 including the barrier ribs 130 of the present invention, the above problems can be solved. Referring to FIG. 4, when a vacuum pressure is generated in the discharge cells 126, the impurity gas remaining in the discharge cells 126 is exhausted through paths 151 and 153 between the barrier ribs 130, and the discharge gas can be filled in the discharge cells 126 through the paths 151 and 153. Although the paths 151 and 153 are eccentrically formed with respect to each other, when these are compared to the stripe type barrier ribs, the eccentric arrangement does not influence the vacuum pressure. In addition, when the recess portions 132 are formed on the barrier ribs 130, the impurity gas can be exhausted and the discharge gas can be filled through paths 152 and 154 passing through the non-discharge areas 128, and thus, the exhausting and filling of the gas can be performed easily.

In addition, when the charges particles are accelerated by the electric fields formed by the electrical potentials applied to the electrodes 114 and 122 in the discharge cells 126, the protrusions 131 formed on the barrier ribs 130 prevent the charged particles from moving between neighboring discharge cells 126 along the barrier rib 130*s*, and thus, the cross talk between the discharge cells 126 can be prevented. Therefore, the cross talk between the neighboring discharge cells 126 can be prevented while performing the exhausting and filling operations of the discharge gas sufficiently, and thus, a high quality image can be obtained.

Since the protrusions 131 are formed on the barrier ribs 130 and the adjacent discharge cells 126 in the direction where the barrier ribs 130 extend are eccentrically formed, the discharge cells 126 can be defined exactly. Therefore, the pixels can be defined clearly, and a fine quality image can be obtained.

According to the PDP of the present invention, the following effects can be obtained.

Since the impurity gas remaining in the PDP can be exhausted sufficiently and the discharge gas can be filled easily, the purity of discharge gas in the discharge cell can be improved and the image quality of the PDP can be improved.

The cross talk between the neighboring discharge cells can be prevented, and the discharge cells can be defined exactly, and thus, a high quality image can be obtained.

In addition, shortening of the lifespan of the PDP due to the impurity gas can be prevented.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Plasma Display Panel (PDP), comprising:

a transparent front substrate and a rear substrate facing the front substrate;

a plurality of barrier ribs, arranged between the front and rear substrates, and oriented in a direction to define a plurality of discharge cells in which a discharge occurs;

a plurality of electrodes adapted to receive electrical potentials to generate electric fields in the discharge cells;

a phosphor layer arranged in the discharge cells;

a discharge gas contained within the discharge cells:

a non-discharge area where the gas discharge does not occur, the non-discharge area being arranged between the discharge cells in a direction in which the barrier ribs extend; and a recess portion arranged on a portion of the barrier rib defining the non-discharge area.

2. The PDP of claim 1, wherein the discharge cells are staggered with respect to each other in the direction in which the barrier ribs are oriented.

3. The PDP of claim 2, wherein each of the barrier ribs is oriented alternately in left and right directions with respect to a direction in which the barrier rib extends.

4. The PDP of claim 1, wherein each barrier rib further includes a protrusion protruding in a direction crossing the barrier rib.

5. The PDP of claim 1, wherein the electrodes comprise sustain electrodes extending in a direction crossing a direction in which the barrier ribs extend, and address electrodes extending to cross the sustain electrodes at the discharge cells.

6. A Plasma Display Panel (PDP), comprising:

a transparent front substrate and a rear substrate facing the front substrate;

a plurality of barrier ribs, arranged between the front and rear substrates, and oriented in a zigzag direction to define a plurality of discharge cells in which a discharge occurs;

a plurality of electrodes adapted to receive electrical potentials to generate electric fields in the discharge cells;

a phosphor layer disposed in the discharge cells; and a discharge gas contained within the discharge cells;

wherein the discharge cells adjacent to each other in a direction in which the barrier ribs extend are eccentric with respect to each other;

a non-discharge area where the gas discharge does not occur, the non-discharge area being arranged between the discharge cells in a direction in which the barrier ribs extend; and a recess portion arranged on a portion of the barrier rib defining the non-discharge area.

7. The PDP of claim 6, wherein each of the barrier ribs is oriented alternately in left and right directions with respect to a direction in which the barrier rib extends.

8. The PDP of claim 6, wherein each barrier rib further includes a protrusion protruding in a direction crossing the barrier rib.

9. The PDP of claim 8, wherein the protrusion extends in both directions toward insides of the discharge cells defined by the barrier ribs.

10. The PDP of claim 6, wherein the electrodes comprise sustain electrodes extending in a direction crossing a direction in which the barrier ribs extend, and address electrodes extending to cross the sustain electrodes at the discharge cells.

11. The PDP of claim 10, further comprising a front dielectric layer covering the sustain electrodes arranged on the front substrate, the sustain electrodes being supported and arranged on the front substrate.

12. The PDP of claim 10, wherein the address electrodes are supported and arranged on the rear substrate.

13. The PDP of claim 12, further comprising a rear dielectric layer covering the address electrodes arranged on the rear substrate.

14. The PDP of claim 12, wherein the address electrodes are staggered with respect to each other along a direction in which the barrier ribs extend.

* * * * *